US007989132B2

(12) United States Patent
Nakamura et al.

(10) Patent No.: US 7,989,132 B2
(45) Date of Patent: Aug. 2, 2011

(54) IMAGE SHEET FORMING METHOD AND IMAGE SHEET FORMING APPARATUS

(75) Inventors: Reki Nakamura, Kanagawa (JP); Megumi Ohtoshi, Kanagawa (JP); Masumi Sato, Kanagawa (JP); Shiro Kondo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 666 days.

(21) Appl. No.: 11/976,133

(22) Filed: Oct. 22, 2007

(65) Prior Publication Data

US 2010/0330495 A9 Dec. 30, 2010

(30) Foreign Application Priority Data

Oct. 26, 2006 (JP) ..... 2006-291006

(51) Int. Cl.
*G03G 13/24* (2006.01)

(52) U.S. Cl. ..... 430/124.11

(58) Field of Classification Search ..... 430/124.11; 399/397

See application file for complete search history.

(56) References Cited

U.S. PATENT DOCUMENTS

| | | | | |
|---|---|---|---|---|
| 5,337,132 | A * | 8/1994 | Cherian | 430/126.1 |
| 5,441,838 | A | 8/1995 | Pane | |
| 5,659,843 | A | 8/1997 | Takano et al. | |
| 6,360,065 | B1 | 3/2002 | Ishibashi et al. | |
| 6,519,428 | B1 | 2/2003 | Ohtoshi et al. | |
| 6,690,908 | B1 | 2/2004 | Gayoso | |
| 7,260,354 | B2 * | 8/2007 | Ishida | 399/409 |
| 2005/0196203 | A1 * | 9/2005 | Tsuda et al. | 399/341 |
| 2006/0159913 | A1 * | 7/2006 | Kugo et al. | 428/347 |

FOREIGN PATENT DOCUMENTS

| | | |
|---|---|---|
| JP | 10-508706 | 8/1998 |
| JP | 11-002915 | 1/1999 |
| JP | 3071465 | 5/2000 |
| JP | 2000-275969 | 10/2000 |
| JP | 2001-305894 | 11/2001 |
| JP | 2002-341623 | 11/2002 |
| JP | 2003-270991 | 9/2003 |
| JP | 2004-191678 | 7/2004 |

* cited by examiner

*Primary Examiner* — Thorl Chea
(74) *Attorney, Agent, or Firm* — Harness, Dickey & Pierce, P.L.C.

(57) ABSTRACT

An image sheet forming method includes supplying a first sheet including a non-transparent layer, and transferring a toner image onto a toner image carrying surface of the first sheet. The method further includes integrating a second sheet, which includes a base layer and a transparent layer, with the first sheet in a manner that the toner image is sandwiched between the toner image carrying surface of the first sheet and the transparent layer of the second sheet. The method further includes separating the base layer from the second sheet while fixing the toner image.

9 Claims, 4 Drawing Sheets

IMAGE SHEET FORMING METHOD AND IMAGE SHEET FORMING APPARATUS

PRIORITY STATEMENT

The present patent application claims priority from Japanese Patent Application No. 2006-291006 filed on Oct. 26, 2006 in the Japan Patent Office, the entire contents of which are hereby incorporated herein by reference.

BACKGROUND OF THE INVENTION

1. Field of the Invention

Example embodiments generally relate to an image sheet forming method and/or an image sheet forming apparatus, for example, for creating an image sheet carrying a high-quality image.

2. Description of the Related Art

A related-art image forming apparatus, such as a copying machine, a facsimile machine, a printer, or a multifunction printer having two or more of copying, printing, scanning, and facsimile functions, forms a toner image on a recording medium (e.g., a sheet) according to image data by an electrophotographic method. In such a method, for example, a charger charges a surface of an image carrier (e.g., a photoconductor). An optical device emits a light beam onto the charged surface of the photoconductor according to image data to form an electrostatic latent image on the photoconductor. The electrostatic latent image is developed with a developer (e.g., toner) to form a toner image on the photoconductor. A transfer device transfers the toner image formed on the photoconductor onto a sheet. A fixing device applies heat and pressure to the sheet bearing the toner image to fix the toner image on the sheet. The sheet bearing the fixed toner image is then output onto an outside of the image forming apparatus.

A related-art image forming apparatus may form a photographic image having an increased gloss by various methods. For example, one image forming apparatus uses special toner for providing an increased gloss, in which, for example, transparent toner is uniformly applied on a sheet bearing a toner image before the toner image is fixed on the sheet. After fixing, a photographic image is formed on the sheet.

Another example image forming apparatus uses a special recording medium (e.g., a recording sheet) for providing an increased gloss. For example, the recording sheet includes a thermoplastic resin layer on its front and/or back surfaces. After a toner image is fixed on the recording sheet, heat and pressure are further applied to the recording sheet bearing the toner image, so that the surface of the recording sheet may provide a uniform gloss.

Yet another example image forming apparatus includes a fixing device including first and second fixing members to provide an increased gloss. After the first fixing member fixes a toner image on a sheet, the second fixing member including a smooth belt melts the toner image on the sheet again. The sheet bearing the toner image is cooled and separated from the belt. The smooth belt may impart a uniform gloss to the toner image on the sheet.

Yet another example image forming apparatus includes a fixing roller. A cooler is disposed inside the fixing roller. After a toner image is fixed on a sheet, the cooler cools the sheet bearing the toner image. After the temperature of the cooled toner image declines to or below a softening point or a melting point, the sheet bearing the toner image is separated from the fixing roller to form a glossy image and/or a matte image.

Yet another example image forming apparatus uses transparent and non-transparent sheets having a common size. The transparent sheet is layered on the non-transparent sheet so that a toner image is sandwiched between the transparent sheet and the non-transparent sheet. In such an arrangement, the transparent sheet needs to be properly positioned with respect to the non-transparent sheet. Therefore, if the transparent sheet and the non-transparent sheet get out of alignment, edges of the transparent and non-transparent sheets need to be cut and aligned.

When a toner image is transferred onto the transparent sheet, the transparent sheet may have a great thickness because the transparent sheet needs to have the stiffness to withstand conveyance and transfer. Further, the transparent sheet needs to be a material appropriate for transfer. Thus, the material and thickness of the transparent sheet may be limited.

SUMMARY

At least one embodiment may provide an image sheet forming method that includes supplying a first sheet including a non-transparent layer, and transferring a toner image onto a toner image carrying surface of the first sheet. The method further includes integrating a second sheet, which includes a base layer and a transparent layer, with the first sheet in a manner that the toner image is sandwiched between the toner image carrying surface of the first sheet and the transparent layer of the second sheet. The method further includes separating the base layer from the second sheet while fixing the toner image.

At least one embodiment may provide an image sheet forming apparatus that includes a supplier, a transfer member, a nip, a separator, and/or a fixing member. The supplier supplies a first sheet including a non-transparent layer. The transfer member transfers a toner image onto a toner image carrying surface of the first sheet supplied by the supplier. The nip sandwiches the toner image between the first sheet and a second sheet including a base layer and a transparent layer, in a manner that the transparent layer of the second sheet faces the toner image carrying surface of the first sheet. The separator separates the base layer from the second sheet. The fixing member fixes the toner image sandwiched between the first sheet and the second sheet.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
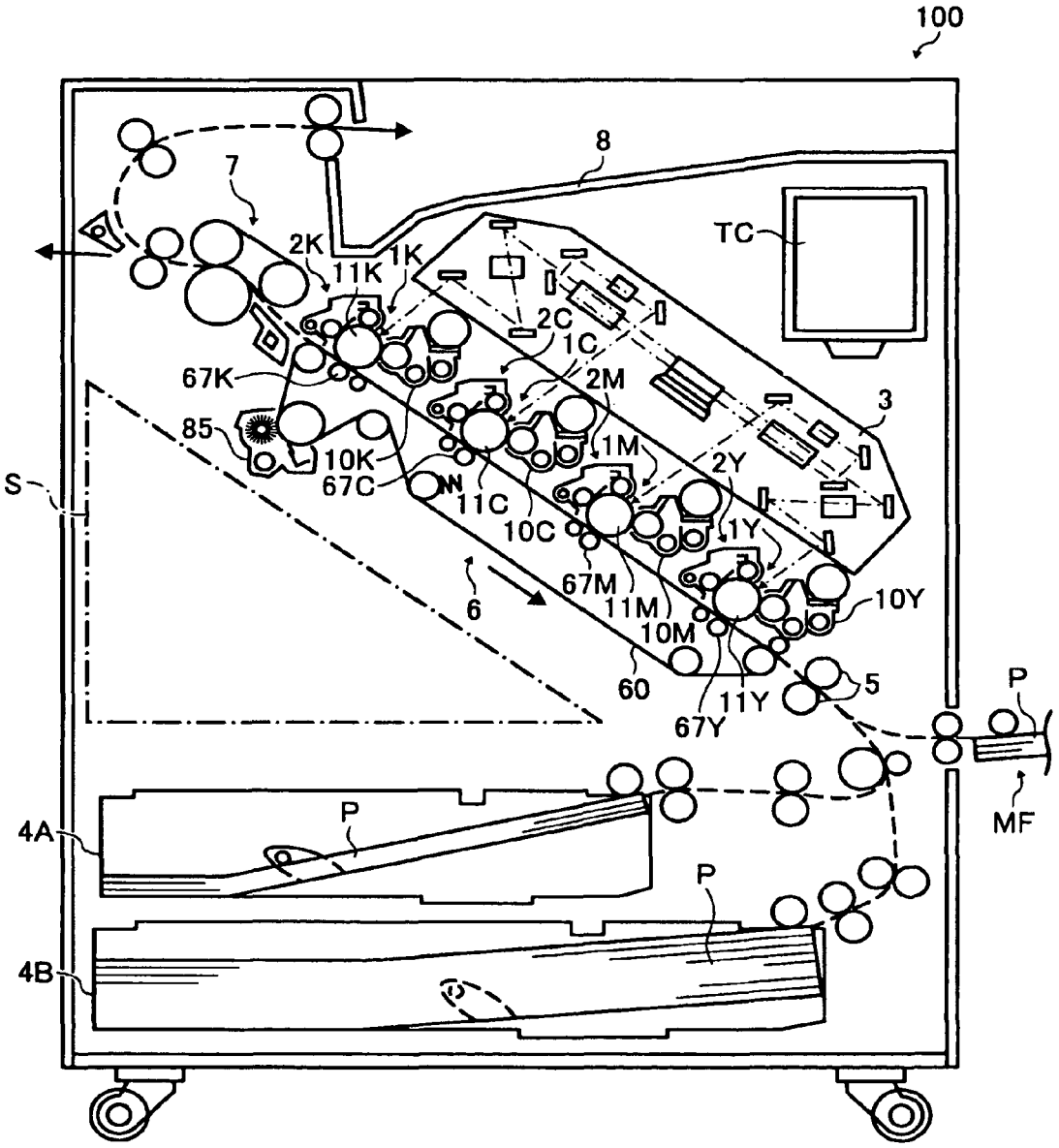
FIG. 1 is a sectional view of an image sheet forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 100 according to an example embodiment is explained.

As illustrated in FIG. 1, the image forming apparatus 100 includes paper trays 4A and 4B, a bypass tray MF, a registration roller pair 5, an optical writer 3, four image forming devices 1Y, 1M, 1C, and 1K, a toner supply container TC, a transfer device 6, a cleaner 85, a fixing device 7, and/or an output tray 8. The image forming devices 1Y, 1M, 1C, and 1K include photoconductor units 2Y, 2M, 2C, and 2K, respectively. The photoconductor units 2Y, 2M, 2C, and 2K include photoconductors 11Y, 11M, 11C, and 11K and/or development devices 10Y, 10M, 10C, and 10K, respectively. The transfer device 6 includes a transfer belt 60 and/or first transfer rollers 67Y, 67M, 67C, and 67K.

The image forming apparatus 100, serving as an image sheet forming apparatus, may be a copying machine, a facsimile machine, a printer, a multifunction printer having two or more of copying, printing, scanning, and facsimile functions, or the like. According to this non-limiting example embodiment, the image forming apparatus 100 functions as a color printer for forming a color image on a recording medium by an electrophotographic method.

The paper trays 4A and 4B are disposed in a lower portion of the image forming apparatus 100. The paper trays 4A and 4B load a recording medium (e.g., sheets P) including plain paper. The bypass tray MF is disposed on a side of the image forming apparatus 100. The bypass tray MF loads a recording medium (e.g., sheets P) including thick paper and an OHP (overhead projector) transparency. A sheet P is fed from the paper tray 4A, the paper, tray 4B, or the bypass tray MF toward the registration roller pair 5.

The optical writer 3 is disposed above the image forming devices 1Y, 1M, 1C, and 1K. The optical writer 3 includes a light source (not shown), a polygon mirror (not shown), an fθ lens, and/or a mirror. The optical writer 3 emits a laser beam onto a surface of each of the photoconductors 11Y, 11M, 11C, and 11K according to image data so as to form an electrostatic latent image on each of the photoconductors 11Y, 11M, 11C, and 11K.

The image forming devices 1Y, 1M, 1C, and 1K form yellow, magenta, cyan, and black toner images, respectively. According to this non-limiting example embodiment, the image forming devices 1Y, 1M, 1C, and 1K are arranged in this order. However, the image forming devices 1Y, 1M, 1C, and 1K may be arranged in other order.

The photoconductor units 2Y, 2M, 2C, and 2K included in the image forming devices 1Y, 1M, 1C, and 1K include the photoconductors 11Y, 11M, 11C, and 11K, chargers (not shown), the development devices 10Y, 10M, 10C, and 10K, and/or cleaners (not shown), respectively. Each of the photoconductors 11Y, 11M, 11C, and 11K is formed in a drum-like shape and serves as an image carrier for carrying a toner image. The image forming devices 1Y, 1M, 1C, and 1K are arranged in a manner that rotating shafts of the photoconductors 11Y, 11M, 11C, and 11K are disposed in parallel to each other and a reference pitch is provided between the photoconductors 11Y, 11M, 11C, and 11K adjacent to each other in a sheet conveyance direction in which a sheet P fed from the paper tray 4A, the paper tray 4B, or the bypass tray MF is conveyed under the photoconductors 11Y, 11M, 11C, and 11K.

The development devices 10Y, 10M, 10C, and 10K have a common structure, but contain toners in colors different from each other, respectively. For example, the development devices 10Y, 10M, 10C, and 10K contain a two-component developer including magnetic carriers and toners in yellow, magenta, cyan, and black colors, respectively.

Each of the development devices 10Y, 10M, 10C, and 10K includes a development roller (not shown), a screw (not shown), and/or a toner density sensor (not shown). The development devices 10Y, 10M, 10C, and 10K develop the electrostatic latent images formed on the photoconductors 11Y, 11M, 11C, and 11K with the yellow, magenta, cyan, and black toners, respectively. The development roller opposes each of the photoconductor 11Y, 11M, 11C, and 11K. A sleeve is rotatably provided on an outer surface of the development roller. A magnet is provided inside the development roller. The screw conveys and agitates the developer contained in each of the development devices 10Y, 10M, 10C, and 10K. The toner supply container TC supplies the yellow, magenta, cyan, and black toners to the development devices 10Y, 10M, 10C, and 10K, respectively, in accordance with an output sent from the toner density sensor.

The transfer device 6, serving as a transfer member, is disposed under the image forming devices 1Y, 1M, 1C, and 1K. In the transfer device 6, the transfer belt 60 carries and conveys a sheet P, which is fed by the registration roller pair 5, under the image forming devices 1Y, 1M, 1C, and 1K. The first transfer rollers 67Y, 67M, 67C, and 67K oppose the photoconductors 11Y, 11M, 11C, and 11K, respectively, via the transfer belt 60. The first transfer rollers 67Y, 67M, 67C, and 67K transfer and superimpose the yellow, magenta, cyan, and black toner images formed on the photoconductors 11Y, 11M, 11C, and 11K, respectively, onto the sheet P conveyed on the transfer belt 60. Thus, a color toner image is formed on the sheet P.

The cleaner 85 contacts an outer circumferential surface of the transfer belt 60. The cleaner 85 includes a brush roller (not shown) and a cleaning blade (not shown), and removes a foreign substance (e.g., toner) from the outer circumferential surface of the transfer belt 60.

The fixing device 7, serving as a fixing member, is disposed beside the transfer device 6. The fixing device 7 fixes the color toner image on the sheet P by a belt fixing method, and feeds the sheet P bearing the fixed color toner image toward the output tray 8. The output tray 8 receives the sheet P fed from the fixing device 7.

The image forming apparatus 100 further includes a waste toner bottle (not shown), a duplex-reverse device (not shown), and/or a power source device (not shown) in a space S illustrated in a broken line.

Referring to FIG. 1, the following describes an image forming operation performed in the image forming apparatus 100 having the above-described structure.

A power source (not shown) applies a reference voltage to chargers (not shown) opposing the photoconductors 11Y, 11M, 11C, and 11K, so as to charge the surfaces of the photoconductors 11Y, 11M, 11C, and 11K at a reference potential, respectively. The optical writer 3 emits and scans laser beams onto the charged surfaces of the photoconductors 11Y, 11M, 11C, and 11K according to image data, so as to form electrostatic latent images on the photoconductors 11Y, 11M, 11C, and 11K. When the rotating photoconductors 11Y, 11M, 11C, and 11K move the electrostatic latent images to the development devices 10Y, 10M, 10C, and 10K, respectively, the development rollers included in the development devices 10Y, 10M, 10C, and 10K and opposing the photoconductors 11Y, 11M, 11C, and 11K supply yellow, magenta, cyan, and black toners to the electrostatic latent images, so as to form yellow, magenta, cyan, and black toner images, respectively.

The above-described operation is performed in the photoconductor units 2Y, 2M, 2C, and 2K at reference times. Thus, the yellow, magenta, cyan, and black toner images are formed on the surfaces of the photoconductors 11Y, 11M, 11C, and 11K, respectively.

A sheet P is fed from the paper tray 4A, the paper tray 4B, or the bypass tray MF toward the registration roller pair 5. When the sheet P reaches the registration roller pair 5, the sheet P is temporarily stopped. The registration roller pair 5 feeds the sheet P in accordance with the times when the photoconductor units 2Y, 2M, 2C, and 2K form the yellow, magenta, cyan, and black toner images, respectively, so that the yellow, magenta, cyan, and black toner images are successively transferred and superimposed onto the sheet P conveyed on the transfer belt 60 to form a color toner image on the sheet P. For example, a power source (not shown) applies a voltage, having a polarity opposite to a polarity of the yellow, magenta, cyan, and black toner images formed on the photoconductors 11Y, 11M, 11C, and 11K, to the first transfer rollers 67Y, 67M, 67C, and 67K, respectively.

The sheet P bearing the color toner image after passing opposing positions formed between the photoconductors 11Y, 11M, 11C, and 11K and the first transfer rollers 67Y, 67M, 67C, and 67K, respectively, is conveyed to the fixing device 7. The fixing device 7 applies heat and pressure to the sheet P to fix the color toner image on the sheet P.

The structure of the image forming apparatus 100 is not limited to the above-described structure. For example, according to this non-limiting example embodiment, the light source included in the optical writer 3 emits a laser beam. However, the light source may include a LED (light-emitting diode). The two-component developer including magnetic carriers and toners is used to form a toner image. However, a one-component developer including toner may be used. The fixing device 7 may include a belt, a roller, and/or an induction heater for heating a sheet P.

Figure 2:
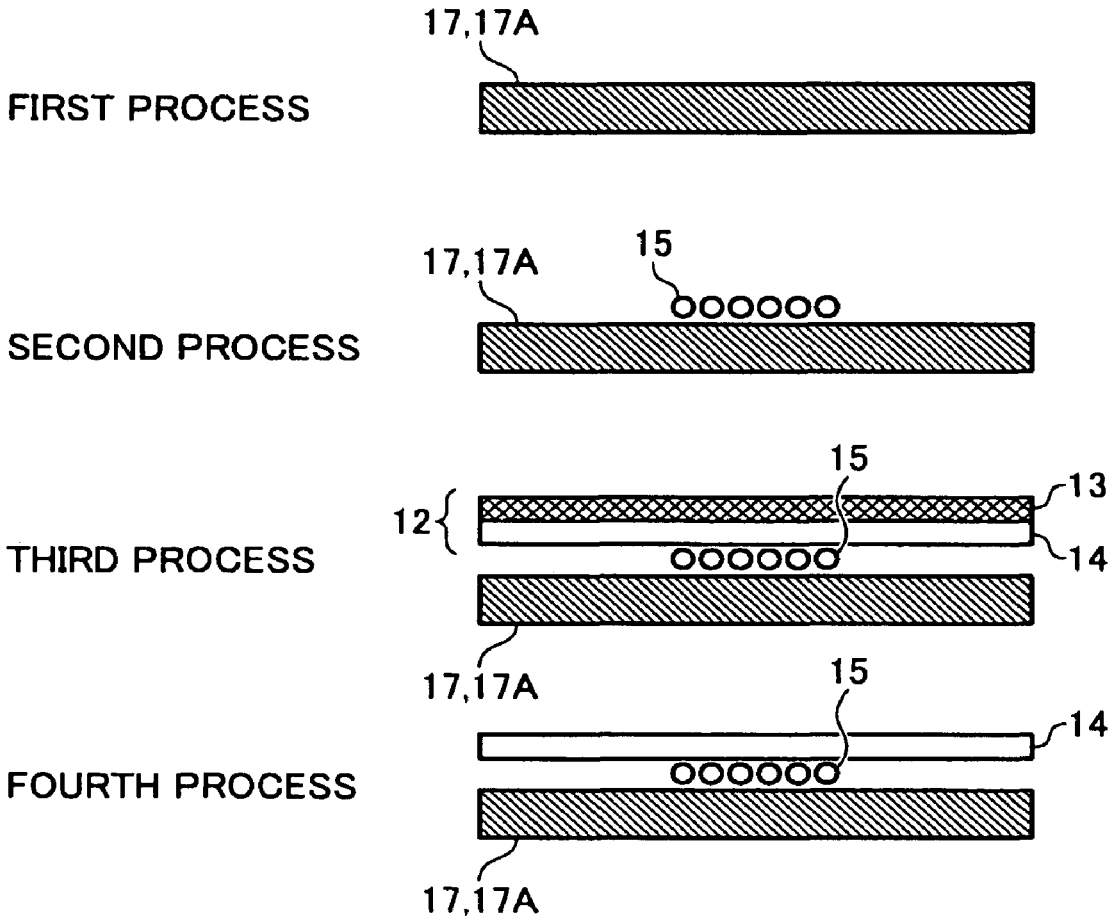
FIG. 2 is a sectional view (according to an example embodiment) of a first sheet and a second sheet used in the image sheet forming apparatus shown in FIG. 1.

Referring to FIG. 2, the following describes sheets (e.g., a first sheet 17 and a second sheet 12) used in the image forming apparatus 100 (depicted in FIG. 1). The first sheet 17 (e.g., a sheet P depicted in FIG. 1) is fed from the paper tray 4A, the paper tray 4B, or the bypass tray MF (depicted in FIG. 1), serving as a supplier, and carries a toner image 15. The second sheet 12 includes a base layer 13 and/or a transparent layer 14. The second sheet 12 is layered on the first sheet 17 in a manner that the second sheet 12 and the first sheet 17 sandwich the toner image 15 formed on the first sheet 17. For example, the transparent layer 14 of the second sheet 12 contacts the toner image 15 on the first sheet 17.

The transparent layer 14 of the second sheet 12 may include a material having a melting point (e.g., a fusion temperature), which is by about 30 degrees centigrade or more higher than a melting point of toner. For example, when the toner has a melting point of about 100 degrees centigrade, the transparent layer 14 may include a material having a melting point of about 130 degrees centigrade. The material included in the transparent layer 14 may not be clear and colorless, and may be nearly transparent when formed into a sheet. For example, the transparent layer 14 may include a sheet material, such as nylon (e.g., polyamide and/or the like). Alternatively, the transparent layer 14 may include a film material, such as a polyolefin resin (e.g., polyethylene, polypropylene, polymethylpentene, and/or the like), a polyester resin (e.g., polyethylene terephthalate (PET), polybutylene terephthalate (PBT), and/or the like), vinyl chloride, an acrylic resin, and/or a urethane resin. A material included in the transparent layer 14 may be selected based on a glass transition point (Tg) instead of the melting point of toner.

The following describes an example method for measuring a glass transition point. The glass transition point may be measured by TG-DSC system TAS-100 available from Rigaku Corporation.

An aluminum container containing a test sample in an amount of about 100 mg is placed in a holder unit and set in an electric furnace. The test sample is heated from a room temperature up to about 150 degrees centigrade at a heating speed of about 10 degrees centigrade per minute. The test sample is left at about 150 degrees centigrade for about 10 minutes. The test sample is cooled down to the room temperature and left for about 10 minutes. The test sample is heated up to about 150 degrees centigrade again at a heating speed of about 10 degrees centigrade per minute under a nitrogen atmosphere to perform DSC measurement. An analysis system of the system TAS-100 calculates a glass transition point based on a tangent line of an endothermic curve near the glass transition point and a contact point of a base line. A difference between a glass transition point of toner and a glass transition point of a material included in the transparent layer 14 may be about 30 degrees centigrade or more, preferably about 50 degrees centigrade or more.

The transparent layer 14 may include an adhesive layer (e.g., a thermosensitive, adhesive layer). In this case, the transparent layer 14 includes a base and/or the adhesive layer. The adhesive layer contacts a toner image 15 on the first sheet 17 or a toner image carrying surface of the first sheet 17.

The following describes the adhesive layer. The adhesive layer includes an adhesive agent. The adhesive agent includes a solid plasticizer and/or a thermoplastic resin emulsion as essential components. The adhesive agent, may further include an adhesion applier as needed. A mixture of the solid plasticizer, the thermoplastic resin emulsion, and/or the adhesion applier is applied on the base (e.g., a base media) serving as a support to form a layer. Thus, the adhesive layer is formed.

A surface of the adhesive layer does not provide viscosity in a room temperature, but provides viscosity when heated. Even after a heat source is removed, the adhesive layer may provide viscosity for a while. When the adhesive layer sticks to a toner image 15 on the first sheet 17 or the toner image carrying surface of the first sheet 17, the adhesive layer is adhered to the first sheet 17 semipermanently. When the adhesive layer is heated, the solid plasticizer is melted, and the thermoplastic resin and the adhesion applier are dissolved, providing viscosity. The thermosensitive, adhesive layer of the transparent layer 14 does not include a peel-and-stick sheet which is generally used as an adhesive material, resulting in resource saving and environmental protection. When the thermosensitive, adhesive material is heated while the adhesive layer contacts an adherend (e.g., the first sheet 17), the adhesive layer is adhered to the first sheet 17, preventing or reducing adhesion errors.

When the solid plasticizer includes at least one of compounds including a benzoate group, a benzophenone group, a phenylenediamine group, and/or a benzothiazole group, the solid plasticizer provides an increased viscosity at a low temperature.

For example, the compound including the benzoate group includes a compound 1 shown in Table 1 below. Examples of the compound 1 include 3,5-dibutyl-4 hydroxy benzoate-1-(2,4-bis-isopentane)phenyl. The compound including the benzophenone group includes compounds 2 to 4 shown in Table 1 below. Examples of the compound 2 include 2-oxy-3-benzyloxy benzophenone. Examples of the compound 3 include 2,4-dioxy benzophenone. Examples of the compound 4 include 2-oxy-4-methoxy-5-sulfonyl benzophenone. The compound including the phenylenediamine group includes compounds 5 and 6 shown in Table 1 below. Examples of the compound 5 include (meta)acryloxy-2-hydroxy propylene phenylenediamine. Examples of the compound 6 include tosyl phenylenediamine. The compound including the benzothiazole group includes compounds 7 and 8 shown in Table 1 and compounds 9 to 13 shown in Table 2 below. Examples of the compound 7 include 2-(4-dithiomorpholino)benzothiazole. Examples of the compound 8 include 2-(cyclohexylaminothio)benzothiazole. Examples of the compound 9 include 2-(cyclohexylaminohydroxythio)benzothiazole. Examples of the compound 10 include 2-(o,p-dinitrobenzylthio)benzothiazole. Examples of the compound 11 include 2-(dicyclohexylaminothio)benzothiazole. Examples of the compound 12 include 2,6-diphenyl-4-o-hydroxy-p-hexyloxyphenyl-1,3,5-triazine. Examples of the compound 13 include β-diphenyl-α-cyanoacrylate ethylester. However, the compounds including the benzoate group, the benzophenone group, the phenylenediamine group, and the benzothiazole group are not limited to the above. The compound 1 including the benzoate group, the compound 2 including the benzophenone group, the compound 5 including the phenylenediamine group, and the compound 7 including the benzothiazole group provide an increased viscosity in an environment of low temperature, because the thermoplastic resin and the adhesion applier provide an increased compatibility.

TABLE 1

| | |
|---|---|
| Compound 1<br>Melting point: 151 degrees centigrade<br>Symmetry number: 1 | 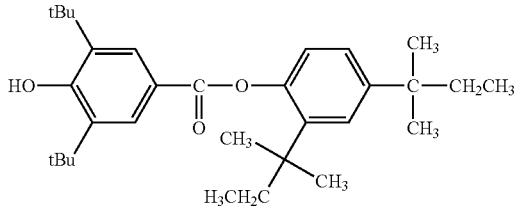 |
| Compound 2<br>Melting point: 115 degrees centigrade<br>Symmetry number: 1 | 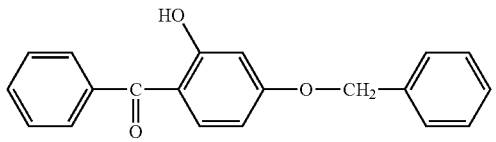 |

TABLE 1-continued

| | |
|---|---|
| Compound 3<br>Melting point: 142<br>degrees centigrade<br>Symmetry number: 1 | 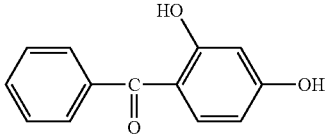 |
| Compound 4<br>Melting point: 110<br>degrees centigrade<br>Symmetry number: 1 | 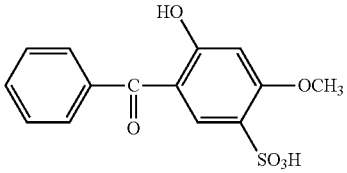 |
| Compound 5<br>Melting point: 115<br>degrees centigrade<br>Symmetry number: 1 | 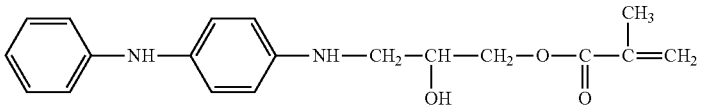 |
| Compound 6<br>Melting point: 140<br>degrees centigrade<br>Symmetry number: 1 | 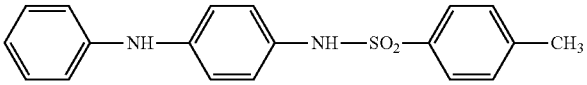 |
| Compound 7<br>Melting point: 123<br>degrees centigrade<br>Symmetry number: 1 | 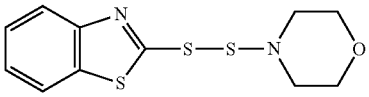 |
| Compound 8<br>Melting point: 95<br>degrees centigrade<br>Symmetry number: 1 | 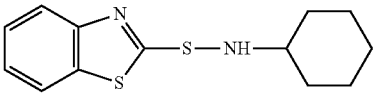 |

TABLE 2

| | |
|---|---|
| Compound 9<br>Melting point: 150<br>degrees centigrade<br>Symmetry number: 1 | 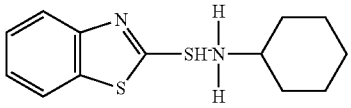 |
| Compound 10<br>Melting point: 155<br>degrees centigrade<br>Symmetry number: 1 | 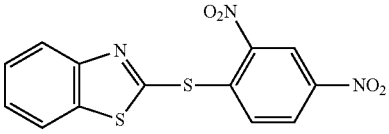 |
| Compound 11<br>Melting point: 95<br>degrees centigrade<br>Symmetry number: 1 | 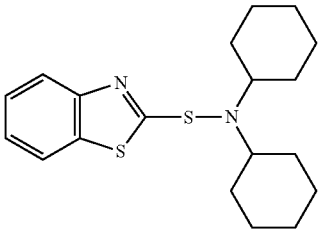 |

TABLE 2-continued

| | |
|---|---|
| Compound 12<br>Melting point: 148<br>degrees centigrade<br>Symmetry number: 1 | 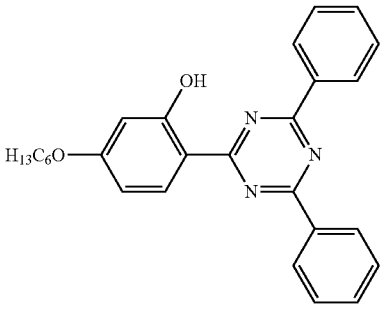 |
| Compound 13<br>Melting point: 95.5<br>degrees centigrade<br>Symmetry number: 1 | 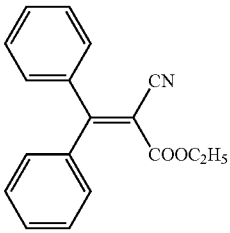 |

The following describes the thermoplastic resin emulsion included in the thermosensitive, adhesive layer. However, other known thermoplastic resin emulsion may be used. Examples of the thermoplastic resin emulsion include a (meta)acrylic ester copolymer, a styrene-isoprene copolymer, a styrene-acrylic ester copolymer, a styrene-butadiene copolymer, an acrylonitrile-butadiene copolymer, an ethylene-vinyl acetate copolymer, a vinyl acetate-acrylic ester copolymer, an ethylene-vinyl chloride copolymer, an ethylene-acrylic ester copolymer, a vinyl acetate-ethylene-vinyl chloride copolymer, a vinyl acetate-ethylene-acrylic ester copolymer, a vinyl acetate-ethylene-styrene copolymer, polybutadiene, and/or polyurethane. For example, when the thermosensitive, adhesive layer includes the acrylic ester copolymer as the thermoplastic resin emulsion, the thermosensitive, adhesive layer may provide an increased viscosity. Especially, the adhesive layer may preferably include 2-ethyl ethylhexyl acrylate which provides an increased viscosity.

An adhesion applier may be added to the thermosensitive, adhesive layer to increase the viscosity of the thermosensitive, adhesive layer. The adhesion applier may include a terpene resin, an aliphatic petroleum resin, an aromatic petroleum resin, a coumarone-indene resin, a styrene resin, a phenolic resin, a terpene phenolic resin, and/or a rosin derivative resin. The adhesion applier in an amount of about 2.0 parts by weight or less, preferably in an amount of about 0.2 parts by weight to about 1.5 parts by weight, is mixed with the thermoplastic resin in an amount of about 1.0 parts by weight. When the amount of the adhesion applier exceeds about 2.0 parts by weight, blocking may easily occur.

When an antiblocking agent is added to the thermosensitive, adhesive layer, blocking may be improved in a high temperature environment. The antiblocking agent includes wax and/or an inorganic filler. Examples of the wax and the inorganic filler are described below, but are not limited to the followings.

Examples of the wax include waxes (e.g., animal and plant wax, synthetic wax, and/or the like), a higher fatty acid, N-hydroxymethyl stearic amide, higher fatty acid amide other than stearic amide, higher fatty acid anilide, an acetyl compound of aromatic amine, paraffin wax, Japan wax, carnauba wax, shellac, montan wax, paraffin oxide, polyethylene wax, and/or polyethylene oxide. Examples of the higher fatty acid include a stearic acid and/or a behenic acid. Examples of the higher fatty acid amide include stearic amide, oleic amide, N-methyl stearic acid amide, erucic acid amide, methylol behenic acid amide, methylol stearic acid amide, methylene bis stearic acid amide, and/or ethylene bis stearic acid amide. Examples of the higher fatty acid anilide include stearic acid anilide and/or linoleic anilide. Examples of the acetyl compound of aromatic amine include acetotoluidide.

Examples of a heat melting material other than wax include a leuco dye and/or a developer generally used as a thermal recording material. A heat melting material, including wax, may preferably have a high melting point so that the heat melting material and the wax may not affect adhesion of the adhesive layer.

Examples of the inorganic filler include a carbonate, an oxide, a hydroxide, and/or a sulfate of aluminum, zinc, calcium, magnesium, barium, and/or titan. Examples of the inorganic filler further include an inorganic pigment including clay (e.g., natural silica, zeolite, carrion, calcined carrion, and/or the like). An inorganic filler may preferably have a low oil-absorb amount so that the inorganic filler may not affect adhesion of the adhesive layer. The antiblocking agent in an amount of about 1.5 parts by weight or less, preferably in an amount of about 0.6 parts by weight to about 1.0 parts by weight, is mixed with the thermoplastic resin in an amount of about 1.0 parts by weight. When the amount of the antiblocking agent exceeds about 1.5 parts by weight, adhesion may easily decrease.

To increase adhesion between the thermosensitive, adhesive layer and the base of the transparent layer 14 or to increase cohesion in the thermosensitive, adhesive layer, the thermosensitive, adhesive layer may include an aqueous polymer binder. Examples of the aqueous polymer binder include polyvinyl alcohol, polyvinyl acetate, starch oxide, etherified starch, a cellulose derivative (e.g., carboxy methyl cellulose, hydroxy ethyl cellulose, and/or the like), casein, gelatin, and/or alginic soda.

When an aqueous polymer binder is added to increase cohesion in the thermosensitive, adhesive layer, the aqueous polymer binder is added in an amount which may not decrease viscosity that a thermosensitive, adhesive sheet originally has. For example, the aqueous polymer binder in an amount of about 30 weight percent or less, preferably in an amount of about 10 weight percent or less, is mixed with respect to the whole solid of the thermosensitive, adhesive layer. In addition to the above-described components, various additives (e.g., a hardener, a preservative, a dye, a developer, a pH adjuster, an antifoaming agent, and/or the like) may be added as needed to the thermosensitive, adhesive layer included in the transparent layer 14 of the second sheet 12.

Referring to FIG. 2, the following describes an image sheet forming method according to an example embodiment of the present invention. In the image sheet forming method, a photographic image is output by using a transparent layer and a non-transparent layer. A toner image is transferred onto a sheet including the non-transparent layer. FIG. 2 illustrates example processes of the image sheet forming method.

In a first process, a first sheet 17 including a non-transparent layer 17A is supplied. In a second process, a toner image 15 is transferred onto the supplied first sheet 17. In a third process, a second sheet 12 including a base layer 13 (e.g., a base sheet) and a transparent layer 14 contacts the first sheet 17 in a manner that the transparent layer 14 contacts the toner image 15 transferred on the first sheet 17. Namely, the second sheet 12 is integrated with (e.g., adhered to) the first sheet 17. In a fourth process, the base layer 13 is separated or removed from the second sheet 12. Through the first process to the fourth process, an image sheet, in which the toner image 15 is sandwiched between the transparent layer 14 of the second sheet 12 and the non-transparent layer 17A of the first sheet 17, is formed. In the fourth process, heat and pressure may be applied to fix the toner image 15.

Figure 3:
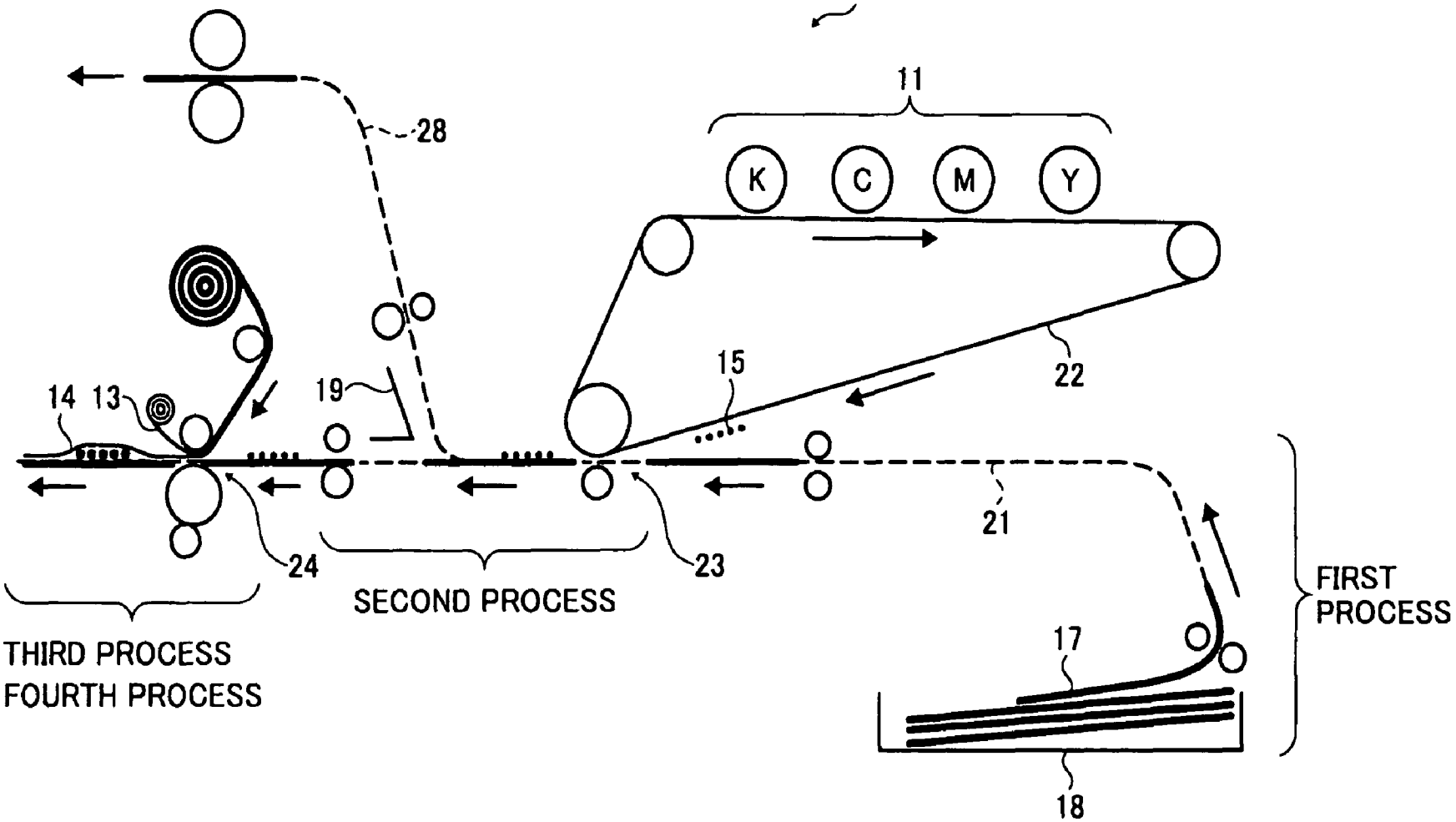
FIG. 3 is a schematic view of an image sheet forming apparatus according to another example embodiment.
Figure 4:
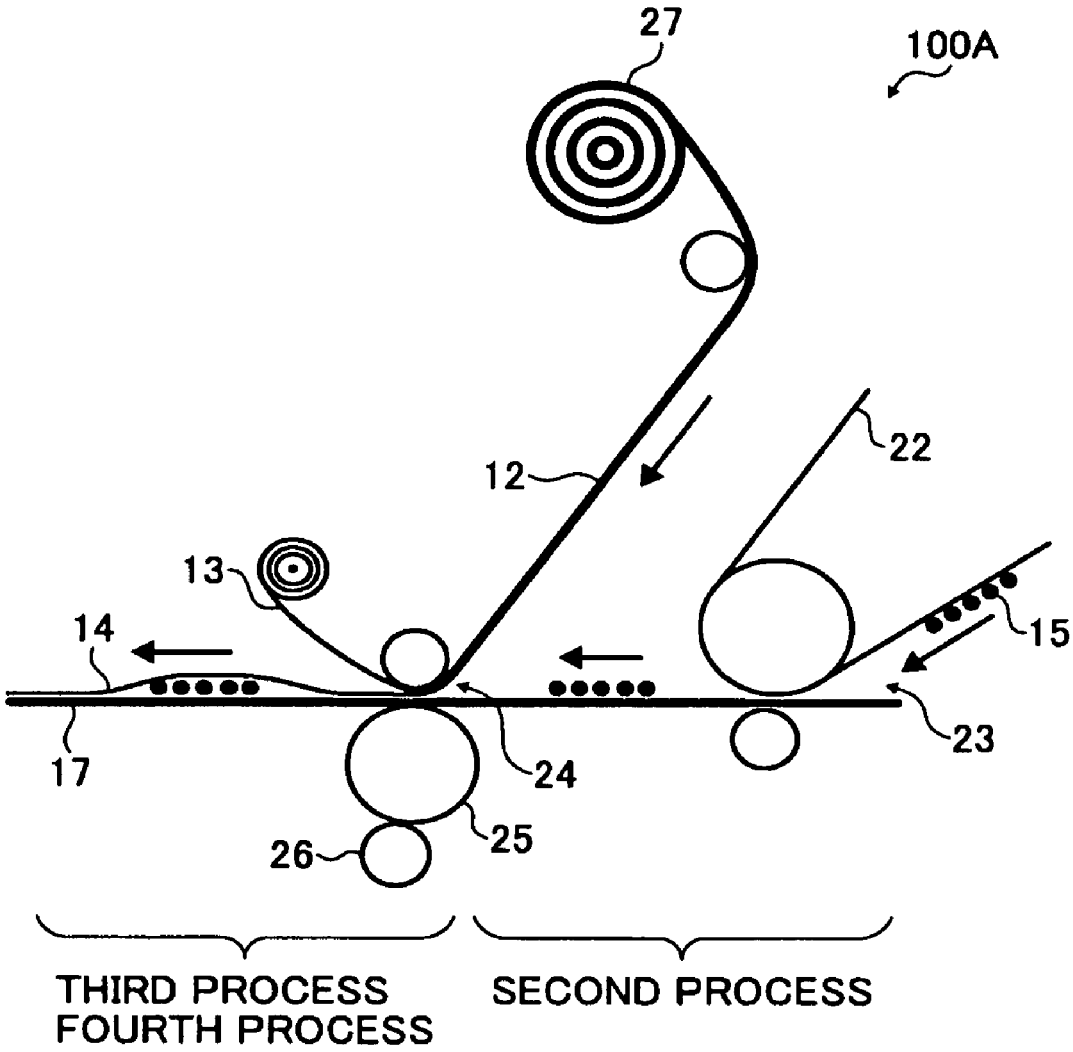
FIG. 4 is an enlarged sectional view (according to an example embodiment) of the image sheet forming apparatus shown in FIG. 3.

Referring to FIGS. 3 and 4, the following describes an image forming apparatus 100A for performing the above-described first to fourth processes. The image forming apparatus 100A, serving as an image sheet forming apparatus, is obtained by adding a structure having a function for forming a photographic image to the image forming apparatus 100 (depicted in FIG. 1) or by modifying the image forming apparatus 100 to be capable of forming a photographic image. Namely, the image forming apparatus 100A has an example structure for forming an image sheet through the first to fourth processes depicted in FIG. 2. FIG. 3 illustrates, elements of the image forming apparatus 100A relating to the first to fourth processes. FIG. 4 illustrates elements of the image forming apparatus 100A, which are provided near the first sheet 17 and relate to the second to fourth processes.

As illustrated in FIG. 3, the image forming apparatus 100A includes a paper tray 18, the photoconductors 11Y, 11M, 11C, and 11K, a transfer belt 22, a conveyance path 21, a transfer nip 23, a conveyance nip 24, a branch mechanism 19, and/or a second sheet conveyance path 28.

As illustrated in FIG. 4, the image forming apparatus 100A further includes a second sheet roll 27, a fixing roller 25, and/or a cleaning roller 26.

As illustrated in FIG. 3, in a first process, a first sheet 17 including the non-transparent layer 17A (depicted in FIG. 2) is fed from the paper tray 18 serving as a supplier. Yellow, magenta, cyan, and black toner images are formed on the photoconductors 11Y, 11M, 11C, and 11K, respectively. The yellow, magenta, cyan, and black toner images are transferred and superimposed onto the transfer belt 22, serving as a transfer member, to form a toner image 15 (e.g., a color toner image). When the rotating transfer belt 22 conveys the toner image 15 to the transfer nip 23, the toner image 15 is transferred from the transfer belt 22 onto the first sheet 17 conveyed on the conveyance path 21 to the transfer nip 23 at a proper time in the second process. According to this non-limiting example embodiment, the image forming apparatus 100A forms the toner image 15 through digital processing without reversing an image. However, the image forming apparatus 100A may form an image either by a digital method or an analog method.

As illustrated in FIG. 4, a second sheet 12 including the base layer 13 and the transparent layer 14 is fed from the second sheet roll 27 serving as a separator or a separating roller. The second sheet 12 and the first sheet 17 are conveyed to the conveyance nip 24 serving as a nip for sandwiching the toner image 15 between the second sheet 12 and the first sheet 17. In the third process, the second sheet 12 is adhered to the first sheet 17 so that the toner image 15 is sandwiched between the second sheet 12 and the first sheet 17. Thus, an image sheet, in which the toner image 15 is sandwiched between the second sheet 12 and the first sheet 17, is formed. In the fourth process performed simultaneously with the third process, the base layer 13 is separated from the transparent layer 14. In the fourth process, pressure and heat may be applied to the second sheet 12 and/or the first sheet 17 to fix the toner image 15, after the base layer 13 is separated from the transparent layer 14.

The second sheet roll 27 may preferably include the second sheet 12 formed in a consecutive (e.g., endless) roll shape. According to this non-limiting example embodiment, an upstream branch pipe (not shown) disposed upstream from a downstream branch pipe (not shown) in a sheet conveyance direction rolls out the second sheet 12, and the downstream branch pipe rolls up the second sheet 12. In the third process, the toner image 15 transferred from the transfer belt 22 onto the first sheet 17 is sandwiched between the second sheet 12 and the first sheet 17 and is integrated with the second sheet 12 and the first sheet 17 at the conveyance nip 24. The first sheet 17 including the non-transparent layer 17A (depicted in FIG. 2) bearing the toner image 15 is conveyed to the conveyance nip 24 at a proper time when a toner image carrying surface of the first sheet 17, which bears the toner image 15, is adhered to a surface of the transparent layer 14, which faces the toner image 15. The non-transparent layer 17A of the first sheet 17, which bears the toner image 15, is integrated with the transparent layer 14 of the second sheet 12. The downstream branch pipe rolls up the base layer 13 of the second sheet 12.

The fixing roller 25, serving as a fixing member, may preferably apply heat to the second sheet 12 contacting the first sheet 17. The heat melts toner forming the toner image 15. Accordingly, the toner image 15 is adhered to the transparent layer 14 of the second sheet 12. As a result, an image providing an increased gloss equivalent to a silver-salt photograph (e.g., a highly glossy image), when viewed through the transparent layer 14, may be formed. The toner image 15 needs to be adhered to the transparent layer 14 to form a photographic image. For example, when the toner image 15 is not adhered to the transparent layer 14 and air bubbles are generated in a gap between the toner image 15 and the transparent layer 14, the transparent layer 14 may have a rough surface which diffuses light. Thus, an image providing an increased gloss may not be formed. Namely, a high-quality image may not be produced.

The transparent layer 14 includes a material providing easy release of the transparent layer 14 from the base layer 13 at a fixing temperature. Thus, the transparent layer 14 may be easily released from the base layer 13 in a state that the transparent layer 14 is adhered to the non-transparent layer 17A of the first sheet 17. The base layer 13 is separated from the transparent layer 14 in the fourth process.

When the transparent layer 14 is conveyed at the conveyance nip 24, the transparent layer 14 may be preferably formed in a consecutive (e.g., endless) sheet shape. However, the non-transparent layer 17A of the first sheet 17 may be formed in a cut sheet shape. In this case, a space is provided between first sheets 17 successively conveyed. The transparent layer 14 moves on the space. The transparent layer 14 may preferably cover a whole front surface (e.g., a surface facing the transparent layer 14) of the non-transparent layer 17A of the first sheet 17, and may not extend off the non-transparent layer 17A of the first sheet 17. Thus, the transparent layer 14 of the second sheet 12 and the first sheet 17 may have common size and shape to form an image sheet. According to this non-limiting example embodiment, when the transparent layer 14 of the second sheet 12 extends off the non-transparent layer 17A of the first sheet 17, the extended portion may be removed or fused with a back surface of the first sheet 17. Thus, a portion of the transparent layer 14, which is extended off the non-transparent layer 17A of the first sheet 17 and moved to the fixing roller 25, may not be further moved to a back surface of the non-transparent layer 17A of a next first sheet 17. The cleaning roller 26 removes the transparent layer 14 moved to the fixing roller 25. According to this non-limiting example embodiment, the cleaning roller 26 is formed in a roller shape. However, the cleaning roller 26 may be formed in other shape.

The above-described processes produce an image medium (e.g., an image sheet) in which a toner image (e.g., the toner image 15) is sandwiched between a non-transparent layer (e.g., the non-transparent layer 17A of the first sheet 17) and a transparent layer (e.g., the transparent layer 14 of the second sheet 12). The toner image is adhered to the transparent layer. The image medium may provide a photographic image having an increased gloss. The non-transparent layer and the transparent layer may have common size and shape. Therefore, the image medium may be formed in a single sheet.

As illustrated in FIG. 3, the branch mechanism 19 switches the path for conveying the first sheet 17. For example, the branch mechanism 19 guides the first sheet 17 toward a path (e.g., the second sheet conveyance path 28) in which the third and fourth processes are not performed on the first sheet 17 or a path in which the third and fourth processes are performed on the first sheet 17, after the second process is performed on the first sheet 17. When the first sheet 17 is conveyed toward the path in which the third and fourth processes are performed on the first sheet 17, the first sheet 17 is formed into an image sheet through the third and fourth processes. When the first sheet 17 is conveyed toward the second sheet conveyance path 28, the third and fourth processes are not performed on the first sheet 17. Alternatively, the branch mechanism 19 may be provided in a fixing device (e.g., the fixing device 7 depicted in FIG. 1). In this case, the second process is performed on the first sheet 17 before the first sheet 17 enters the fixing device. To form an image sheet, the fixing device is not activated and the third and fourth processes are performed after the first sheet 17 moves out of the fixing device.

As described above, an image sheet forming apparatus (e.g., the image forming apparatus 100 depicted in FIG. 1 or the image forming apparatus 100A depicted in FIGS. 3 and 4) includes a supplier (e.g., the paper tray 4A, the paper tray 4B, or the bypass tray MF depicted in FIG. 1, or the paper tray 18 depicted in FIG. 3), a transfer member (e.g., the transfer device 6 depicted in FIG. 1 or the transfer belt 22 depicted in FIGS. 3 and 4), a nip (e.g., the conveyance nip 24 depicted in FIGS. 3 and 4), a separator (e.g., the second sheet roll 27 depicted in FIG. 4), and/or a fixing member (e.g., the fixing device 7 depicted in FIG. 1 or the fixing roller 25 depicted in FIG. 4).

The supplier supplies a first sheet (e.g., the first sheet 17 depicted in FIGS. 2 to 4) including a non-transparent layer (e.g., the non-transparent layer 17A depicted in FIG. 2). The transfer member transfers a toner image (e.g., the toner image 15 depicted in FIG. 3) onto the first sheet supplied by the supplier. A second sheet (e.g., the second sheet 12 depicted in FIGS. 2 and 4) includes a base layer (e.g., the base layer 13 depicted in FIGS. 2 to 4) and/or a transparent layer (e.g., the transparent layer 14 depicted in FIGS. 2 to 4). The transparent layer is formed on the base layer. The second sheet is layered on the first sheet in a manner that a toner image carrying surface of the first sheet, which carries the toner image, faces the transparent layer of the second sheet via the toner image. For example, the toner image is sandwiched between the first sheet and the second sheet. The separator separates the base layer from the second sheet. The fixing member fixes the toner image in a state that the toner image is sandwiched between the transparent layer of the second sheet and the non-transparent layer of the first sheet. The image sheet forming apparatus may further include a photoconductor (e.g., the photoconductor 11Y, 11M, 11C, and/or 11K depicted in FIGS. 1 and 3) and/or a charger.

The separator may preferably separate the base layer from the transparent layer with a releasing force applied by heat generated by the fixing member. Further, the separator may preferably roll up the separated base layer. For example, the transparent layer may include a layer providing adhesion between the base layer and the transparent layer when heated. The layer may provide a releasing force for releasing. the base layer from the second sheet, which is increased by heat applied for fixing the toner image in the third process. The base layer may be separated from the second sheet in the fourth process. Thus, the transparent layer of the second sheet may be adhered to the first sheet.

According to the above-described non-limiting example embodiments, a toner image is not transferred onto the transparent layer, but onto the non-transparent layer. Therefore, material and/or thickness of the transparent layer may be selected from among various options when the non-transparent layer includes a material appropriate for a transfer process, without considering a transfer property of the second sheet including the transparent layer. Thus, an image having a desired gloss may be formed. Namely, an image sheet in which a toner image is sandwiched between the non-transparent layer and the transparent layer may be formed irrespective of a property (e.g., thickness, softness, and/or the like) of the transparent layer.

When heat melts toner forming a toner image, the toner image is adhered to the surface of the transparent layer without air bubbles generated in a gap between the toner image and the transparent layer. Thus, the transparent layer may have a smooth, plane surface which does not diffuse light. Thus, an image providing an increased gloss may be formed. As a result, a recording medium (e.g., an image sheet) bearing a photographic image having an increased gloss equivalent to a silver-salt photograph may be obtained.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. An image sheet forming method, comprising:

supplying a first sheet including a non-transparent layer;

transferring a toner image onto a toner image carrying surface of the first sheet;

integrating a second sheet, which includes a base layer and a transparent layer, with the first sheet and sandwiching the toner image between the toner image carrying surface of the first sheet and the transparent layer of the second sheet; and separating the base layer from the second sheet while fixing the toner image, wherein a separating roller rolls up the base layer to separate the base layer from the second sheet.

2. The image sheet forming method according to claim 1, wherein the transparent layer includes a layer providing adhesion between the base layer and the transparent layer when heated and providing a releasing force for releasing the base layer from the second sheet, which is increased by heat applied for fixing the toner image so as to separate the base layer from the second sheet and adhere the transparent layer of the second sheet to the first sheet.

3. The image sheet forming method according to claim 1, wherein the transparent layer includes an adhesive layer including thermosensitive, adhesive material contacting the toner image carrying surface of the first sheet, and wherein the thermosensitive, adhesive material includes a solid plasticizer and a thermoplastic resin emulsion.

4. The image sheet forming method according to claim 1, wherein the transparent layer includes a layer providing adhesion between the base layer and the transparent layer when heated and providing a releasing force for releasing the base layer from the second sheet, which is increased by heat applied for fixing the toner image so as to separate the base layer from the second sheet and adhere the transparent layer of the second sheet to the first sheet.

5. The image sheet forming method according to claim 1, wherein the transparent layer includes an adhesive layer including thermosensitive, adhesive material contacting the toner image carrying surface of the first sheet, and wherein the thermosensitive, adhesive material includes a solid plasticizer and a thermoplastic resin emulsion.

6. The image sheet forming method according to claim 2, wherein the transparent layer includes an adhesive layer including thermosensitive, adhesive material contacting the toner image carrying surface of the first sheet, and wherein the thermosensitive, adhesive material includes a solid plasticizer and a thermoplastic resin emulsion.

7. The image sheet forming method according to claim 1, wherein the toner image is fixed in a state when the toner image is sandwiched between the transparent layer of the second sheet and the non-transparent layer of the first sheet.

8. The image sheet forming method according to claim 1, wherein the second sheet is layered on the first sheet in a manner that a toner image carrying surface of the first sheet, which carries the toner image, faces the transparent layer of the second sheet via the toner image.

9. The image sheet forming method according to claim 8, wherein the toner image is sandwiched between the first sheet and the second sheet.

* * * * *